US008863793B2

(12) United States Patent
Black

(10) Patent No.: US 8,863,793 B2
(45) Date of Patent: Oct. 21, 2014

(54) MODULAR ORGANIZATION CASE

(76) Inventor: Micah Black, Los Angeles, CA (US)

( * ) Notice: Subject to any disclaimer, the term of this patent is extended or adjusted under 35 U.S.C. 154(b) by 116 days.

(21) Appl. No.: 13/068,640

(22) Filed: May 16, 2011

(65) Prior Publication Data

US 2011/0277892 A1 Nov. 17, 2011

Related U.S. Application Data

(60) Provisional application No. 61/395,764, filed on May 17, 2010.

(51) Int. Cl.

| | |
|---|---|
| ***A45C 11/00*** | (2006.01) |
| ***A45C 1/06*** | (2006.01) |
| *A45C 1/08* | (2006.01) |
| *A45C 11/18* | (2006.01) |
| *A45C 11/32* | (2006.01) |

(52) U.S. Cl.

CPC ..... *A45C 1/06* (2013.01); *A45C 2001/067* (2013.01); *A45C 2001/086* (2013.01); *A45C 11/182* (2013.01); *A45C 11/321* (2013.01); *A45C 2011/002* (2013.01)

USPC ..... 150/148; 150/131; 150/132; 150/133; 150/134; 150/135; 136/137; 136/138; 136/139; 136/147; 136/148; 206/37; 206/38; 206/39; 206/486; 206/495; 499/536; 499/538; 499/566; D9/520; D9/537; D9/538; D9/540; D9/541

(58) Field of Classification Search

USPC ..... 150/147, 148, 131–139; 206/37, 38, 39, 206/486, 495, 499, 536, 538, 566; D9/520, D9/537, 538, 540, 541, 543

See application file for complete search history.

(56) References Cited

U.S. PATENT DOCUMENTS

| | | | | |
|---|---|---|---|---|
| 6,926,135 | B1 * | 8/2005 | Liebers | 206/6 |
| 7,665,625 | B1 * | 2/2010 | Rothstein et al. | 220/326 |
| 7,918,335 | B1 * | 4/2011 | Kitchen | 206/38 |
| 8,310,826 | B2 * | 11/2012 | Wu et al. | 361/679.3 |
| 8,720,682 | B2 * | 5/2014 | Navon et al. | 206/320 |
| 2007/0095826 | A1 * | 5/2007 | Truong | 220/7 |
| 2007/0284264 | A1 * | 12/2007 | Davis | 206/39 |

* cited by examiner

*Primary Examiner* — Fenn Mathew
*Assistant Examiner* — Cynthia Collado

(57) ABSTRACT

The current invention comprises a mechanical enclosure capable of unifying a plurality of individual personal organization devices into one interchangeable platform. The apparatus maintains high spatial efficiency by use of materials and geometry allowing miscellaneous items to be carried in single compact space, while also allowing for convenient attachment and removal of modular elements for a variety of applications and uses.

1 Claim, 13 Drawing Sheets

MODULAR ORGANIZATION CASE

RELATED APPLICATION INFORMATION

This application claims the benefit of U.S. Provisional Patent Application No. 61/395,764 filed on May 17, 2010, currently pending, entitled MODULAR ORGANIZATION CASE, which application is hereby incorporated by reference in its entirety.

BACKGROUND OF THE INVENTION

This invention relates generally to an apparatus for containing items in a modular fashion. In particular the invention provides a base enclosure, which allows various "attachments" to easily and quickly connect to it allowing for organized transportation, removal, and convenient use of supported items.

DESCRIPTION OF RELATED ART

The mechanical design of typical hinges and dovetails is well established in the prior art. The applicant for the present invention considered several common mechanical casing designs with common features and noted the deficiencies below.

Existing personal carrying cases (especially wallets) are designed to carry common personal items by either creating an array of common sized dividers or a single space in which multiple items are jumbled together without a dividing system. Many attempts to improve the form and function of a typical bifold wallet have been made, but none of prior art inventions have brought the unique features, function, and structural elements of the current invention together. For example U.S. Pat. No. 6,981,591-modular display cases, U.S. Pat. No. 7,117,990-modular wallet reader set, U.S. Pat. No. 2,748,821-pass case with sliding pass holder, U.S. Pat. No. 6,607,122-combined detachable filing wallet device, U.S. Pat. No. 5,103,884-wallet with removable clip were each considered by the applicant for this present invention. The resulting array of dividers or single space design utilized in most cases, bags, packs results in spatial inefficiency and lack of customization for the user. There is therefore need for providing a robust carrier of personal items such that by use of various "attachments" to a modular structure a more efficient and customized carrier is provided.

SUMMARY OF THE INVENTION

The current invention comprises a mechanical enclosure capable of unifying a plurality of individual pocket organization devices into one interchangeable platform. Most wallet designs and variations only carry two mediums such as credit cards and paper currency. These designs do not provide for proper dispensing and storage of other commonly carried items such as coinage, business cards, keys, electronic devices, self defense items, multitools etc. The apparatus defined and described in the current invention maintains high spatial efficiency by use of materials and geometry allowing miscellaneous items to be carried in single compact device.

Thus one aspect of the invention is its inherent modular design including a "base case" element, which is designed to accommodate one or more individual attachment elements. In the exemplary embodiment the base case element is shaped and sized to be used as a wallet, and comprises of two opposing halves that hinge together and lock utilizing a mechanical clasp element. A plurality of attachment elements are contemplated which are designed to be operatively attached and removed from the base case. As will be appreciated from the detailed description below, the attachment elements may include coin holders, key holders, money clips, mp3 or other electronic device holders, and many other elements with additional utility designed to be coupled to the base case. The attachment elements are attached mechanically as shown in the exemplary embodiments, but may be attached magnetically, or via other electromechanical or electromagnetic means.

A better understanding of the objects, advantages, features, properties and relationships of the invention will be obtained from the following detailed description and accompanying drawings which set forth illustrative embodiments and which are indicative of the various ways in which the principles of the invention may be employed.

BRIEF DESCRIPTION OF THE DRAWINGS

For a fuller understanding of the nature and advantages of the present invention, as well as the preferred mode of use, reference should be made to the following detailed description reading conjunction with the accompanying drawings. In the following drawings, like reference numerals designate like or similar parts throughout the drawings.

DETAILED DESCRIPTION OF THE PREFERRED EMBODIMENT

The present description is of the best presently contemplated mode of carrying out the invention. This description is made for the purpose of illustrating the general principles of the invention and should not be taken in a limiting sense.

The present invention can find utility in a variety of implementations without departing from the scope and spirit of the invention, as will be apparent form an understanding of the principles that underlie the invention. For instance, the present invention is best described used in conjunction with pocket items (including, cell phones, smart phones, credit cards, paper currency, coinage, personal media (mp3) devices, receipts, keys, personal defense items, flashlights, multitools, ect) such that the modular case can store, dispense, and facilitate the use of these items. However the present invention may find utility when used in a larger scale such as backpacks, briefcases, ect.

Figure 1:
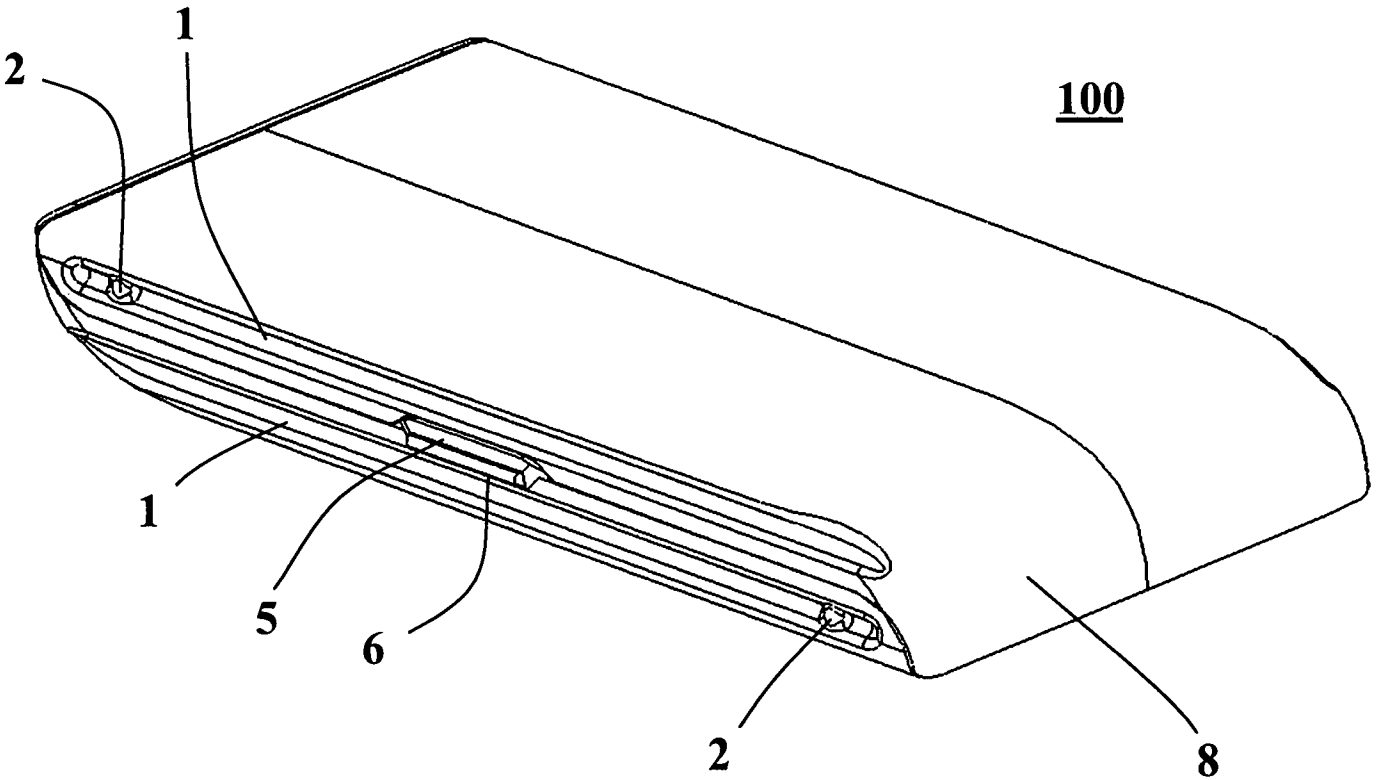
FIG. 1 is an isometric view of the closed base case of the present invention.
Figure 2:
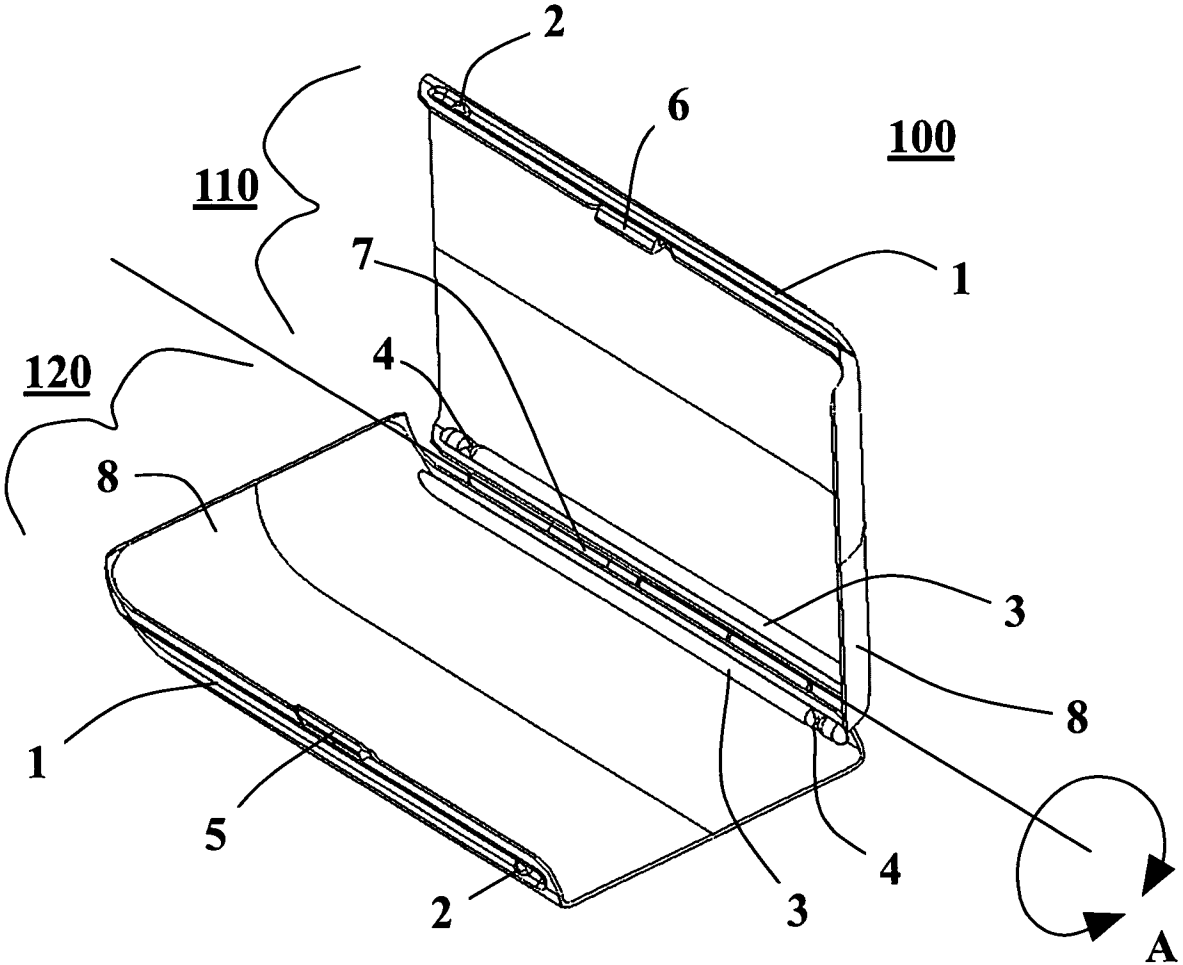
FIG. 2 is an isometric view of the open base case of the present invention.
Figure 3:
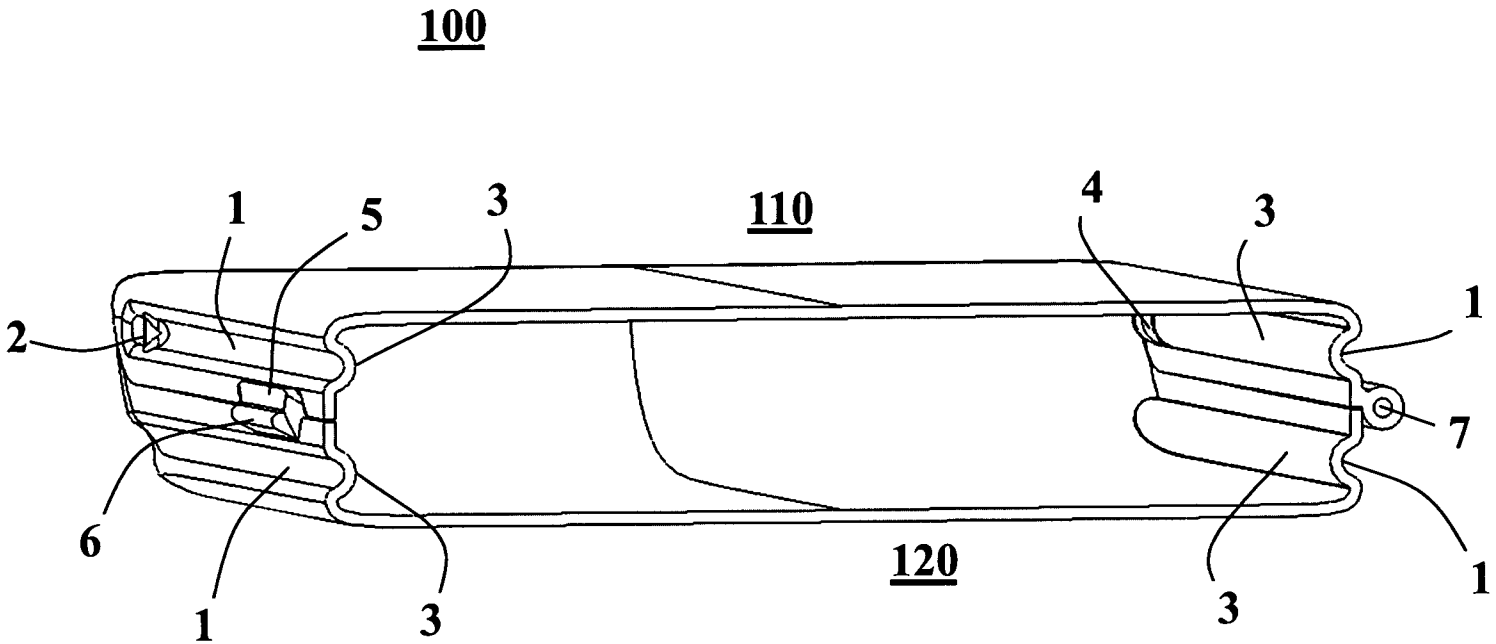
FIG. 3 is a side cutaway of the closed base case of the present invention.

Looking now to FIGS. 1, 2, and 3 various views of exemplary base case apparatus 100 of the modular organization case are shown to schematically illustrate one aspect of the current invention. Generally, base case 100 comprises two halves 110 and 120 connected by a hinge 7 to form an enclosure. In the present embodiment illustrated herein each half is formed in a substantially rectangular shape with rounded edges suitable for use as a wallet. FIG. 1 shows the closed position of the two main halves 110 and 120 with the mating of female clasp 5 and male clasp 6. The present embodiment 100 is created by forming sheet metal halves using a metal stamping press or such other means as may be understood and appreciated by those skilled in the art of metal forming and shaping. Outside indentation feature 1 is a sheet metal formed channel that progresses along symmetrical outside surfaces of base case halves 110 and 120. Inside embossed rib 3 is a result of the manufacturing process of outside indentation feature 1 and follows the geometry of outside indentation 1 through the sheet metal thickness on the inside of base case half 110 and 120. FIG. 3 shows the cross sectional profile of case half 110 and 120 to form base case 100. Outside indentation 1 and inside embossed rib 3 are symmetrical about the width of case half 110 and 120, which forms an inside and outside dovetail feature on case half 110 and 120. Outside indentation 1 and inside embossed rib 3 are also symmetrical over the mating surface of case half 110 and 120 because base case half 110 and 120 are identical except for female clasp 5 and male clasp 6. This symmetry of outside indentation feature 1 and inside embossed rib 3 is the basis for connecting and disconnecting attachments from base case 100. It will be understood that various geometries of de-bossed groves such as exemplary outside indentation features 1 can provide the same functionality as shown in the present embodiment. Slots in the side of the base case, magnets and embossed relief's may be adapted by one skilled in the art to create the same functionality as shown in outside indentation feature 1.

Figure 6:
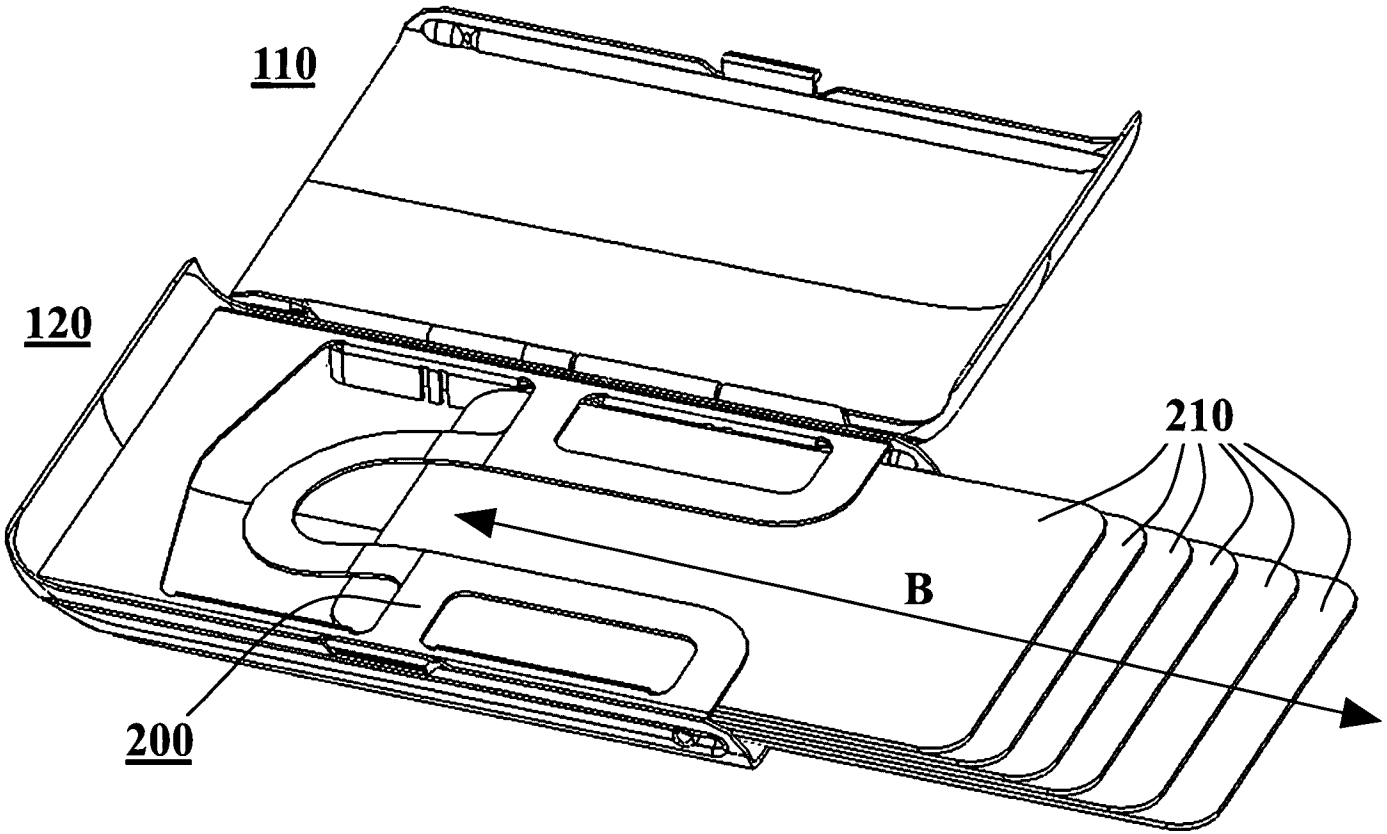
FIG. 6 is an isometric view of the card attachment showing its function and use for the base case in the present embodiment.
Figure 12:
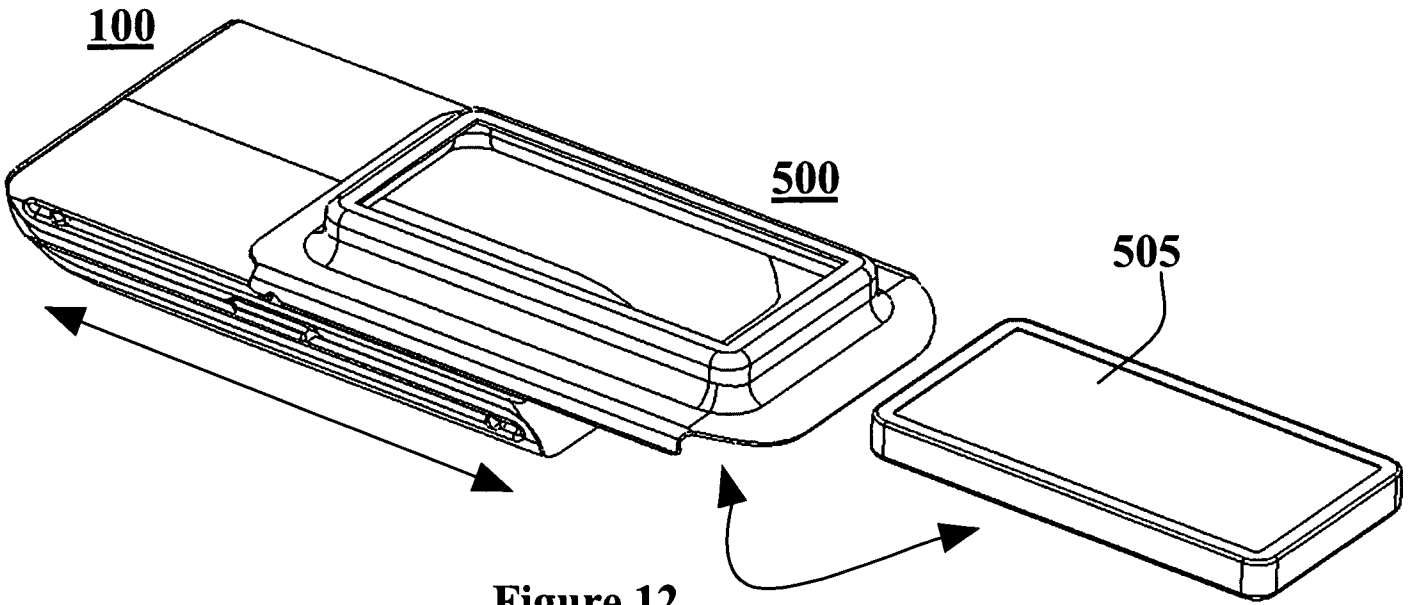
FIG. 12 is an isometric view showing the function of an electronic device attachment for the base case in the present invention.
Figure 13:
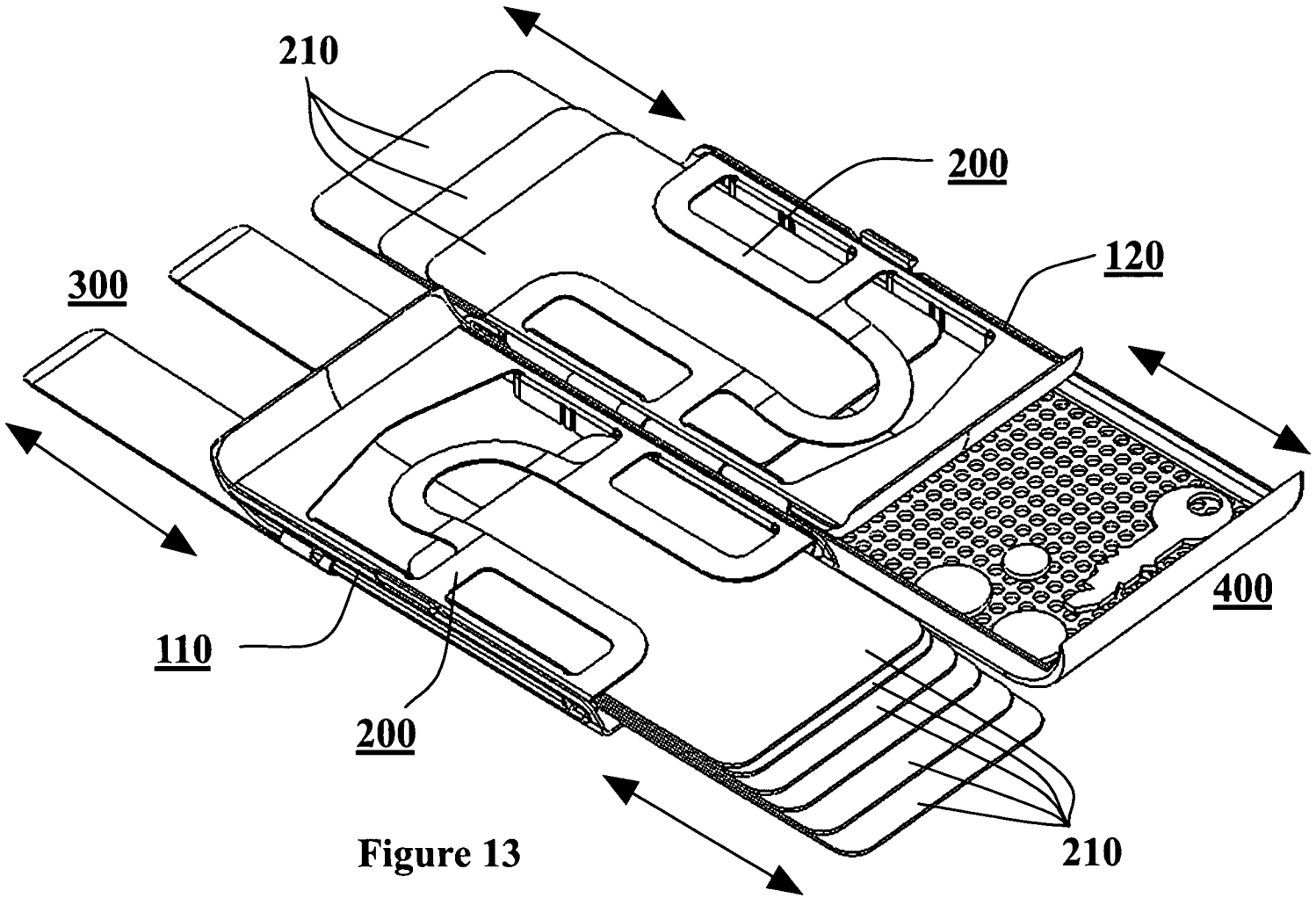
FIG. 13 is an isometric view of the base case with four attachments on it.

Outside catch 2 is a domed emboss formed into outside indentation feature 1 and acts as a permanent and semi permanent catch for fixed and moving attachments as illustrated in FIGS. 8, 10,12 and 13. It will be understood that magnets, debossed domes, hooks, and holes may be adapted by one skilled in the art to create appropriate variations to outside catch 2. Inside catch 4 is a result of the manufacturing process of outside catch 2 and also acts as a permanent and semi permanent catch for fixed and moving attachments as illustrated in FIGS. 6 and 13.

Female clasp 5, male clasp 6 and hinge 7 are well established mechanisms for allowing case half 110 and 120 to mechanically open and clasp together. It will be understood that depending on the material of base case 100, living hinges, folding textiles, rubbers, magnets, interlocking sheets, and other mechanisms may be adapted by one skilled in the art to create a suitable hinge and clasp elements that will not depart from the spirit of the invention. Female clasp 5 and male clasp 6 in the present embodiment use a slot and barb formed from sheet metal to clasp base case 100 together. It will be understood that magnetic elements, rotational clasps, and interference fitting of clasp geometries will create suitable alternate embodiments of female clasp 5 and male clasp 6.

Lip 8 is an elongated tab on one end of each side of base case half 110 and 120. Lip 8 is used as a backstop on one side while the opposing side of each half remains open for sliding attachments and/or any enclosed items.

Figure 4:
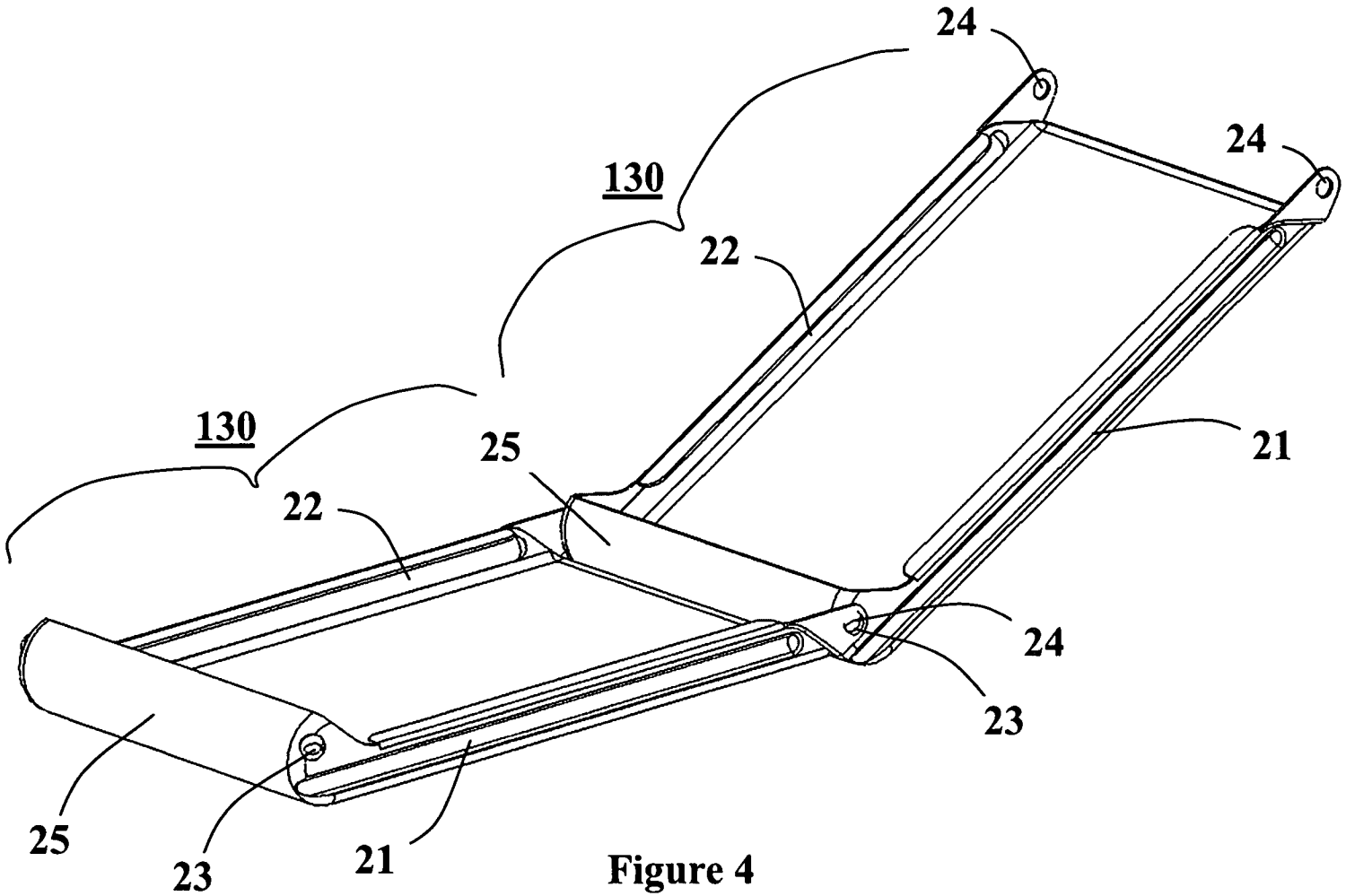
FIG. 4 is an isometric view of another embodiment of the base case in the present invention.

FIG. 4 is an alternate embodiment of base case 100 in which halves 110 and 120 are designed as identical case half 130. Case half 130 hinges longitudinally (90 degrees to that of base case 100). Female clasp 5, male clasp 6 and hinge 7's functionality from base case 100 is incorporated into button 23 and hole tab 24 of embodiment 130 to create a single hinge clasp design. It will be appreciated that the embodiment shown and described in FIG. 4 lends itself to more efficient and cost effective design and manufacturability due to the fact that only one base case element 130 needs to be fabricated in pairs in order to create a mechanically operable case.

Figure 5:
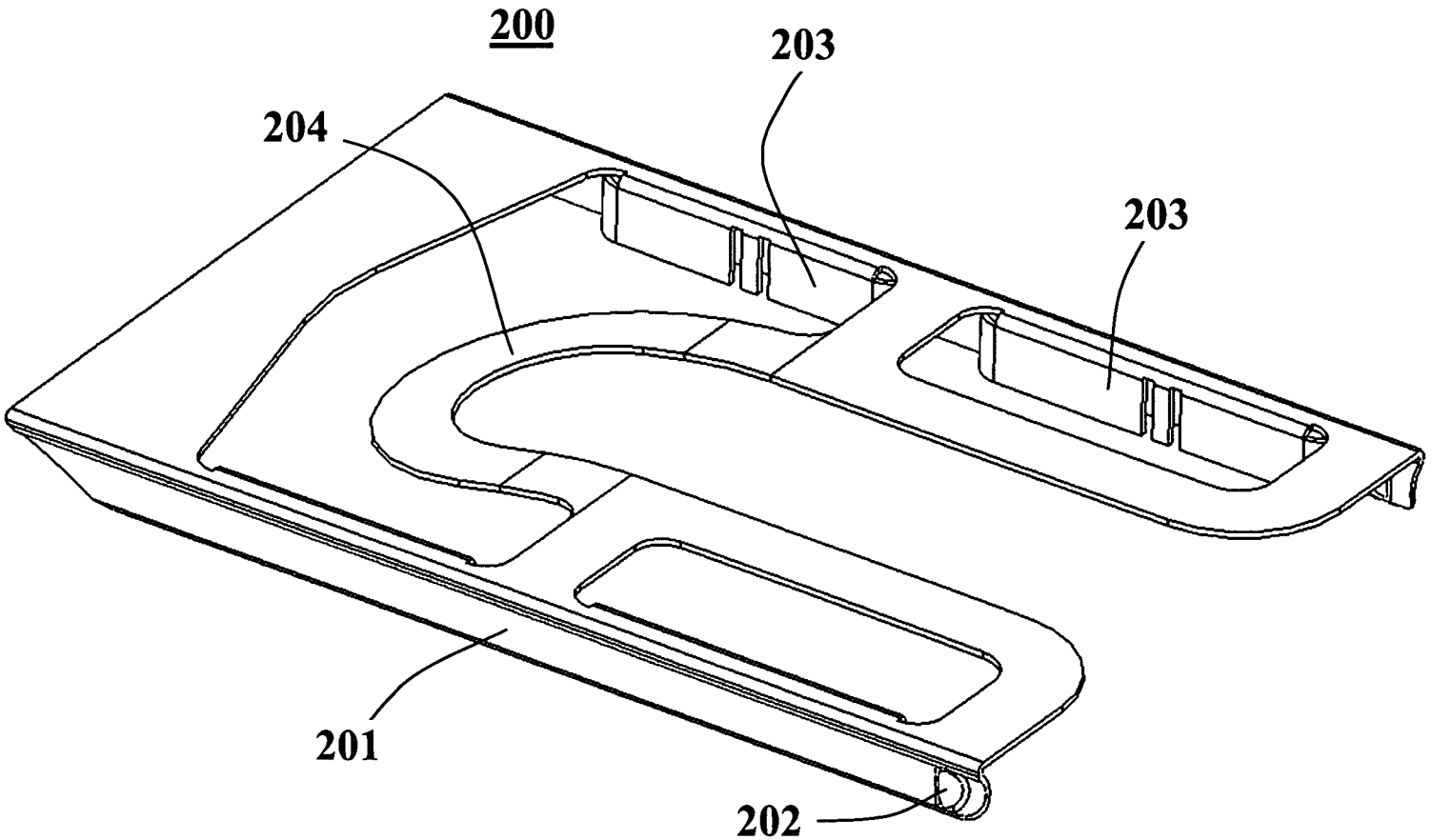
FIG. 5 is an isometric view of the card attachment for the base case in the present invention.

Looking now to FIGS. 5 and 6, attachment 200 inserts into the inside of base case half 110 or 120 or both for storage and dispensing of removable cards 210 (credit cards, business cards, or other similarly sized cards according to the present embodiment). In the present embodiment attachment 200 is constructed from formed sheet metal. It shall be understood that attachment 200 can be fabricated from a combination of materials, or a singular material, such as sheet metal, plastic, wood, and rubber. Indentation 201 is operatively sized and shaped to match the profile of inside embossed rib 3 on both sides of the inside of case halves 110 or 120. The matching profiles of inside embossed rib 3 and indentation 201 allow attachment 200 to securely connect onto the inside of base case half 110 or 120. Moreover inside catch 4 and emboss 202 lock attachment 200 into the base case when it is fully installed along direction B. Tabs 203 and 204 act as guides when sliding removable cards 210 along direction B. Side tabs 203 and top tab 204 exert a force on the removable cards 210 to hold the cards in place at any length along attachment 200. Removable cards 210 are able to be slid in and out of attachment 200 with fingers along the large open slot. It shall be understood that other embodiments of attachment 200 could be implemented to dispense and store a large variety of items including business cards, stun guns, pepper spray, note pads, battery packs, flash lights, paper currency etc. Furthermore, attachment 200 can be installed on the inside of halves 110 and 120 of base case 100 simultaneously while still allowing base case 100 to close. In another embodiment the functional aspects and part features of attachment 200 can be adapted for use on the outside of both case half 110 and 120. This would require indentation 201 to be changed such that it could mate with outside indentation 1 instead of inside embossed rib 3.

Figure 7:
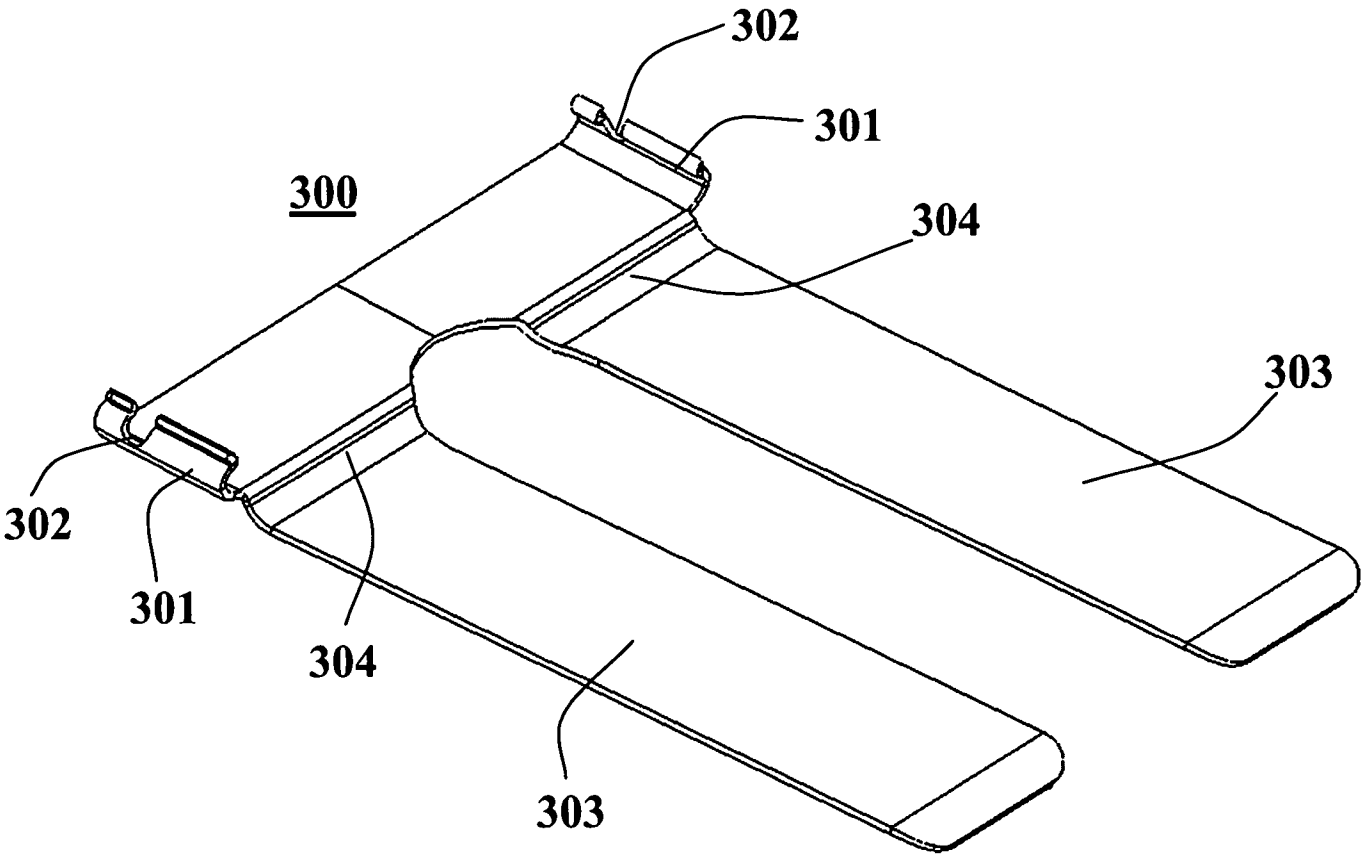
FIG. 7 is an isometric view of a clip attachment for the base case in the present invention.
Figure 8:
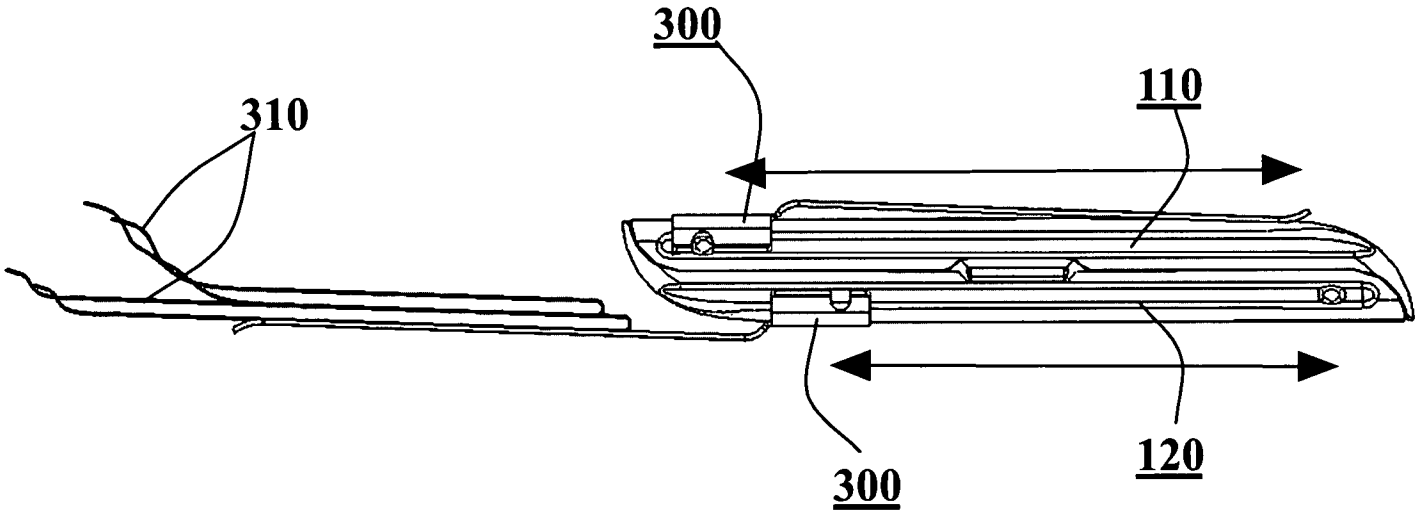
FIG. 8 is a side view of a clip attachment showing its function for the base case in the present embodiment

Looking now to FIGS. 7 and 8, attachment 300 is a clip for holding paper currency 310, receipts or other paper media to the outside of base case half 110 and 120. In the present embodiment attachment 300 is made of formed sheet metal. It shall be under stood that other embodiments of attachment 300 can be constructed from a variety of materials such as wood, plastic, metal and rubber without departing from the spirit of the present invention. Indentation 301 matches the geometry of outside indentation 1. Indentation catch 302 allows attachment 300 to semi permanently locate itself to outside catch 2. Bend 304 and tabs 303 exert a force on the outside of base case 100 in order to securely hold paper elements 310. The entirety of attachment 300 is designed to slide along the length of the base case to better expose paper mediums for dispensing and storage. It is understood that attachment 300 can be implemented on the inside of the base case haft 110 or 120 or both if indentation 301 were to match inside emboss 3 instead of indentation 1 in alternate embodiment.

Figure 9:
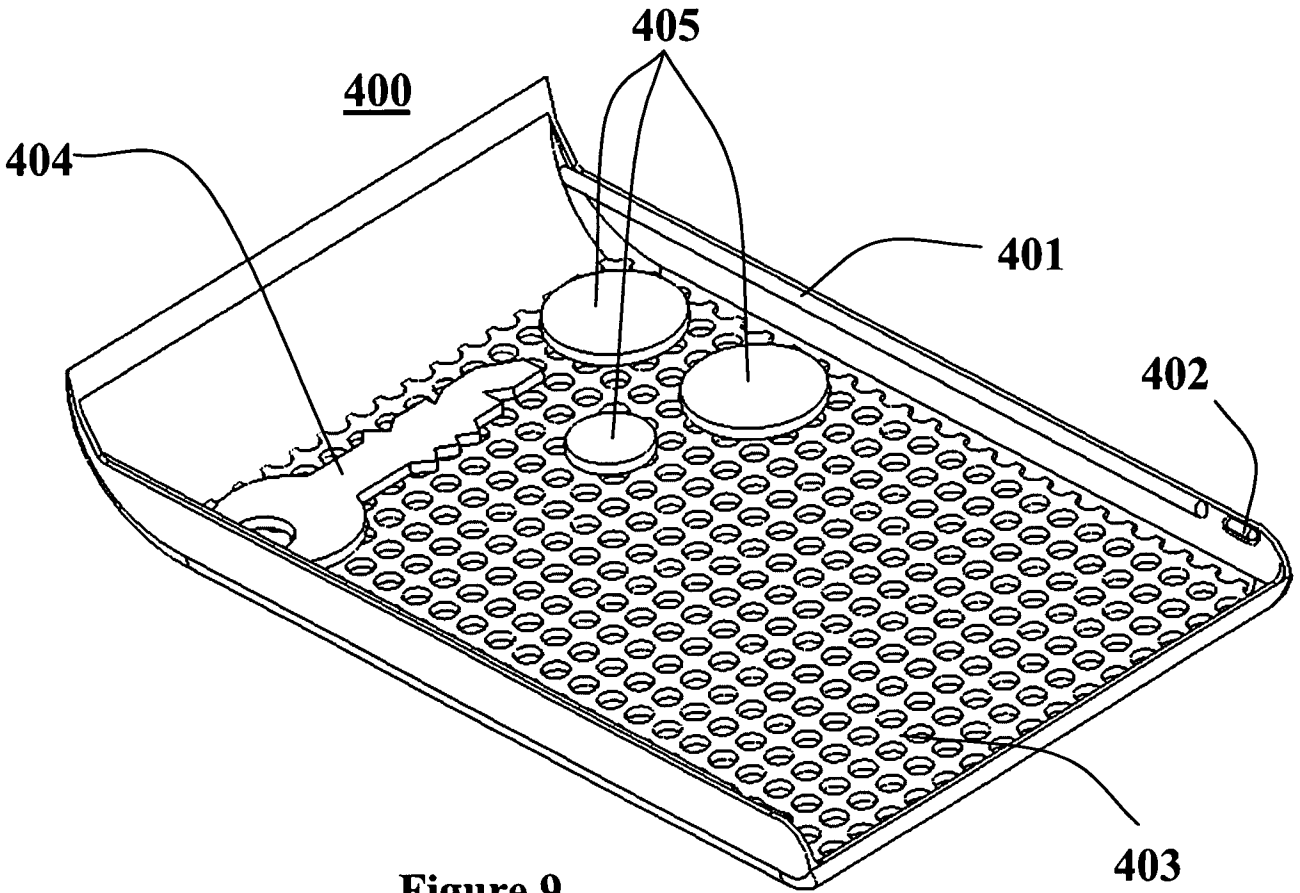
FIG. 9 is an isometric view of the utility tray attachment for the base case in the present embodiment
Figure 10:
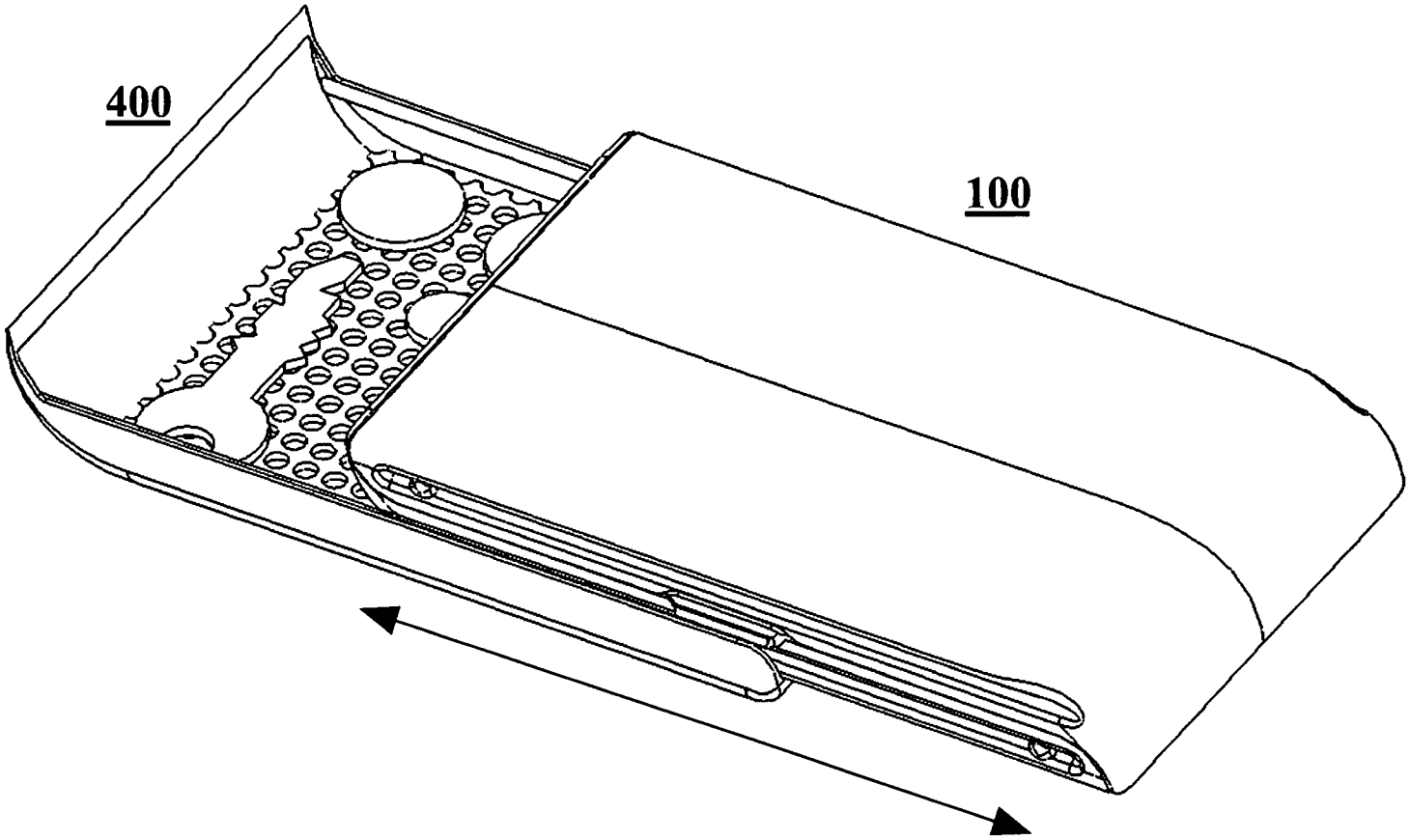
FIG. 10 is an isometric view showing the utility tray attachments function for the base case in the present embodiment.

Looking now to FIGS. 9 and 10 utility tray attachment 400 is designed to hold keys 404, coinage 405, note pads, usb drives, multitools, electronic devices, gps devices, etc. in a tray that attaches to the outside of the base case. In the present embodiment attachment 400 is made from formed sheet metal. It will be understood that a variety of materials and geometries can be used in alternate embodiments of attachment 400. Indention 401 is embossed on the inside of both sides to create an interlocking connection with outside indentation 1, on base case half 110 or 120. Insert element 403 in the present embodiment is a foam insert for attachment 400 in which cut-outs can be made for keys 403, coinage 405, and other miscellaneous items. Insert element 403 helps protect, divide, cushion and compress items within attachment 400. Insert element 403 can be made from a variety of materials including memory foam, thermoplastic, putty, rubber, precut foam, etc without departing from the spirit of the present invention. Base case half 110 or 120 forms the topside enclosure for attachment 400 and indentation catch 402 creates a semi permanent locking feature with outside catch 2. The entirety of attachment 400 slides along the base case to reveal tray contents to the user. It shall be understood that the present embodiment can be used on both outside base case halves 110 and 120 simultaneously. In another embodiment attachment 400 can be designed for the inside of the base case enclosure by mating with inside embossed rib 3 instead of outside indentation 1.

Figure 11:
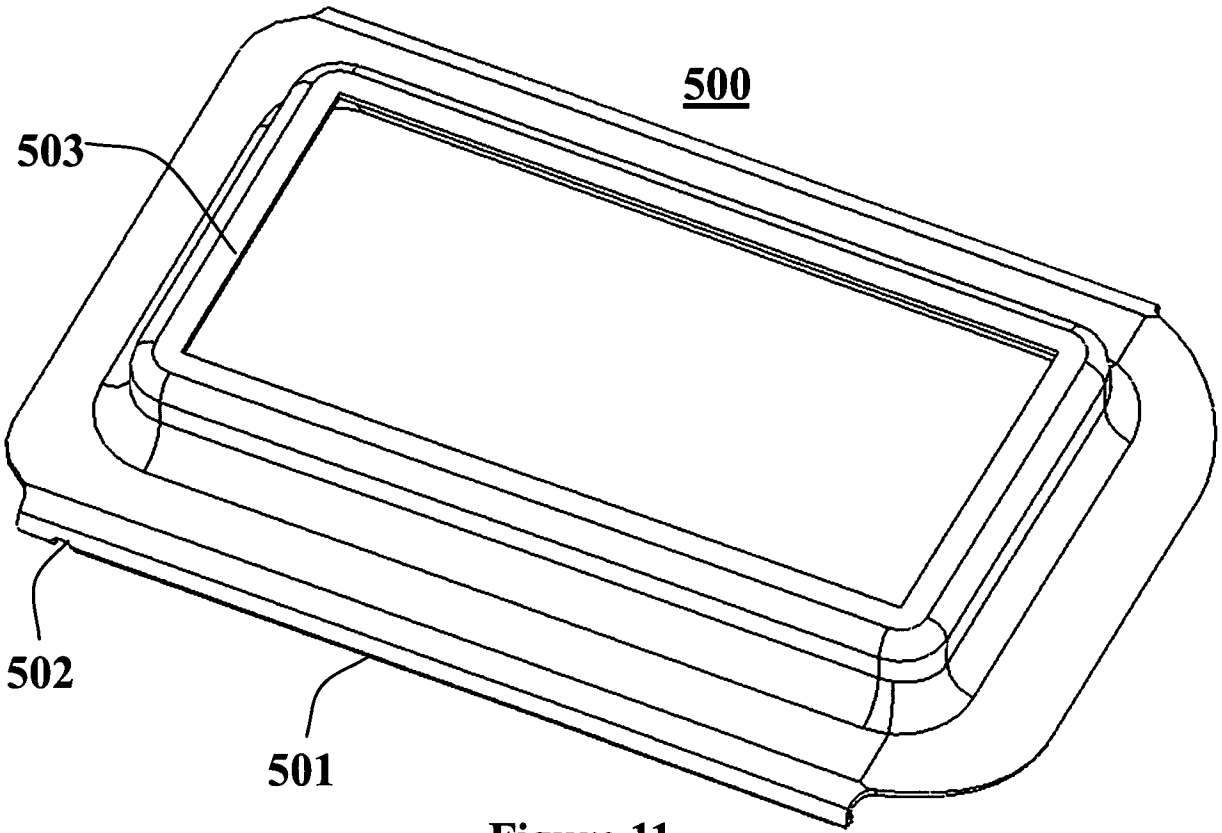
FIG. 11 is an isometric view of an electronic device adaptor attachment for the base case in the present embodiment.

Looking now to FIGS. 11 and 12 is an attachment for enclosing and protecting an electronic device 505 to the outside of the base case 100. Indentation 501 and indentation catch 502 mate with base case elements outside indentation 1 and outside catch 2 to form a sliding connection. In the present embodiment attachment 500 is made from formed sheet metal. It shall be understood that a variety of materials such as plastic, wood and rubber can be used to create alternate embodiments. Attachment 500 is designed as an enclosure that can move along outside indentation 1 of base case to reveal items on the back of the electronic device such as a camera, speaker, microphone, antenna, signal receiver etc. Electronic device 505 represents gps devices, touch screen devices, mobile phones, digital displays (Oled, TFT, etc), MP3 players (iPod, Zune, etc), speakers, batteries, flashlights, anti theft devices, etc. Embossed cradle element 503 protects and locates electronic device 505 in attachment 500. Embossed cradle element 503 is meant to allow use of the electronic device through singular or multiple cutouts in element 503.

Now looking at FIG. 13 base case 100 has a total of 4 attachments installed. It shall be understood that attachments can be used with out obstructing each other because of the design of base case 100. Removable cards 210 can be dispended on either side of the base case while have access to the utility tray 400 and outside clip 300. Furthermore, utility tray 400 and outside clip 300 can be accessed by the user without opening the base case 100 enclosure, as will be the same with any attachment on the outside of base case 100.

What is claimed is:

1. A modular rigid wallet system for securely retaining paper currency comprising a first base case portion, a second base case portion, a first auxiliary base case element, and a second auxiliary base case element, the first base case portion and second based case portion being mechanically operable together via a hinge element to create an enclosure, the enclosure having an inside portion and an outside portion, and wherein;

the first base case portion comprises a first top side and a first bottom side, wherein the first top side is sized and shaped for slidably attaching and detaching the first auxiliary base case element on the outside portion of the enclosure, and the first bottom side is sized and shaped for slidably attaching and detaching the second auxiliary base case element on the inside portion of the enclosure, and;

the second base case portion comprises a second top side and a second bottom side analogous to the first top side and first bottom side of the first base case portion, the second top side being sized and shaped for slidably attaching and detaching the first auxiliary base case element on the outside portion of the enclosure, and the second bottom side being sized and shaped for slidably attaching and detaching the second auxiliary base case element on the inside portion of the enclosure, and;

wherein the hinge element is partially integrated in the first base case portion and partially integrated in the second base case portion, and;

wherein the second auxiliary base case element is sized and shaped as a clip for receiving and holding the paper currency such that when the second auxiliary base case element is slidably attached to the enclosure the paper media is securely retained within the inside of the enclosure.

* * * * *